US005678260A

United States Patent [19]

Belson

[11] Patent Number: 5,678,260

[45] Date of Patent: Oct. 21, 1997

[54] MEANS FOR IMPROVING SENSORY PERCEPTION IN CHILDREN

[76] Inventor: Amir Belson, P.O. Box 3500, Gedera 70700, Israel

[21] Appl. No.: 683,823

[22] Filed: Jul. 18, 1996

[51] Int. Cl.[6] ..... A47D 7/00; A47D 15/00

[52] U.S. Cl. ..... 5/93.1; 5/663; 601/434

[58] Field of Search ..... 5/93.1, 663, 658, 5/424, 655; 446/227; 248/345.1; 601/134

[56] References Cited

U.S. PATENT DOCUMENTS

| | | | |
|---|---|---|---|
| 2,600,556 | 6/1952 | Malm | 5/93.1 |
| 3,627,251 | 12/1971 | Paulison | 5/93.1 |
| 3,866,649 | 2/1975 | Bringmann | 5/663 |
| 4,123,078 | 10/1978 | Murakami | 446/227 |
| 4,767,419 | 8/1988 | Fattore | 5/663 |
| 4,968,279 | 11/1990 | Smith | 446/227 |
| 5,299,335 | 4/1994 | Ivester et al. | 5/641 |

OTHER PUBLICATIONS

"Wheel Cover" An Ad on p. 34 or The Late Spring 1993 Edition of The Lifestyle Fascination Catalogue.

*Primary Examiner*—Alexander Grosz
*Attorney, Agent, or Firm*—Edwin D. Schindler

[57] ABSTRACT

Protrusions are provided in the upper rim of a guard rail of a children's bed or crib, to improve motor development. The protrusions can be provided on an attachment to be attached to the normal upper rim or can be integral with the upper rim. The device can be scented and colored, as well, and differently shaped protrusions can be provided in different sections of the attachment.

19 Claims, 1 Drawing Sheet

MEANS FOR IMPROVING SENSORY PERCEPTION IN CHILDREN

FIELD OF THE INVENTION

The present invention relates to a device for improving sensory perception in children. The device comprises a plurality of protrusions, which can be of various shapes, sizes and arrangements, which are provided on the upper rim guard structure of a child's bed or crib such that when the child gets up and grips this upper rim, it contacts the protrusions.

BACKGROUND OF THE INVENTION

Certain babies progress from the stage of mainly lying down to the stage of standing up, without the regular intermediate stage of crawling. Such children frequently lack delicate motor ability. The generally accepted theory proposes that the application of friction to the palm of the hands aids in the development of delicate motor ability. The conventional treatment is to massage the palm of the baby with special gloves provided with certain protrusions. This requires skilled labor, is time consuming and expensive.

SUMMARY OF THE INVENTION

Instead of this accepted physiotherapy, the present invention provides a novel solution, which is also beneficial to normal babies. In accordance with one aspect of the present invention, an attachment for the upper rim of a guard rail surrounding a bed or crib for a small child, is provided with a plurality of protrusions which can be of various sizes, shapes and arrangements over the surface of the attachment. When attached to the upper rim, the attachment can be gripped by the child when it gets up and holds the upper rim. The device can be scented and/or colored, as well. In accordance with another aspect of the invention, a guard rail for a bed or crib comprises an upper rim with protrusions.

DETAILED DESCRIPTION OF THE INVENTION

Figure 1:
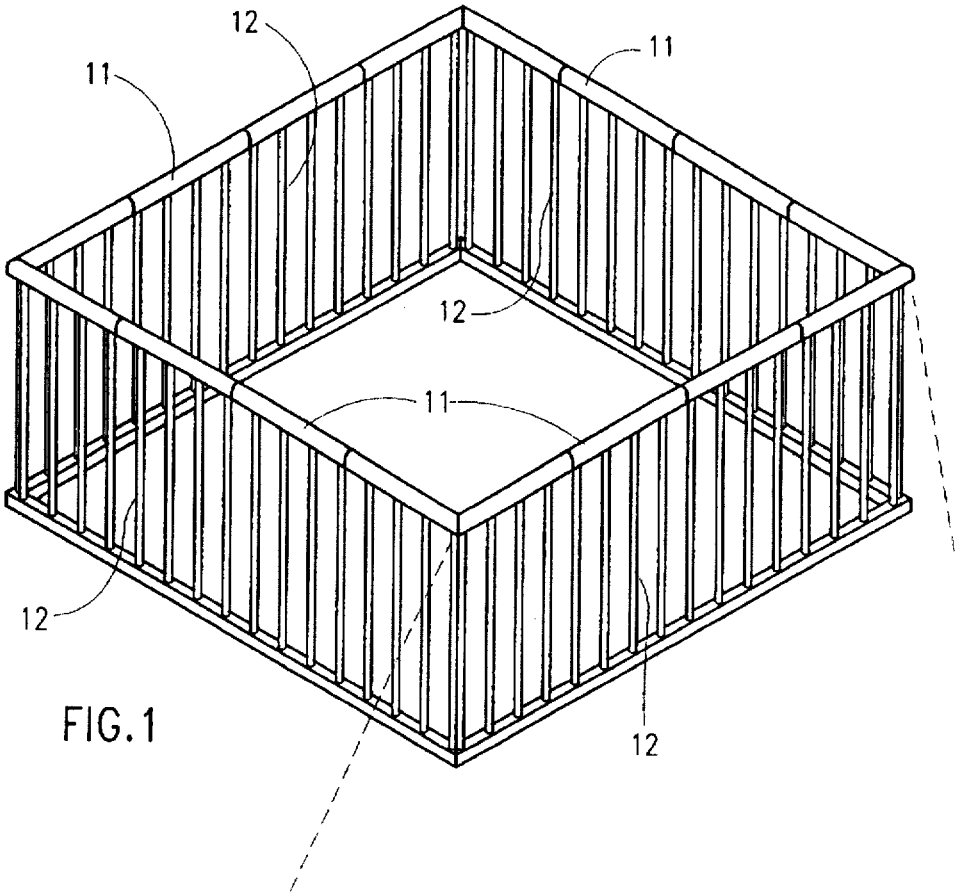
FIG. 1 is a perspective view of a guard rail structure of a bed or crib.
Figure 2:
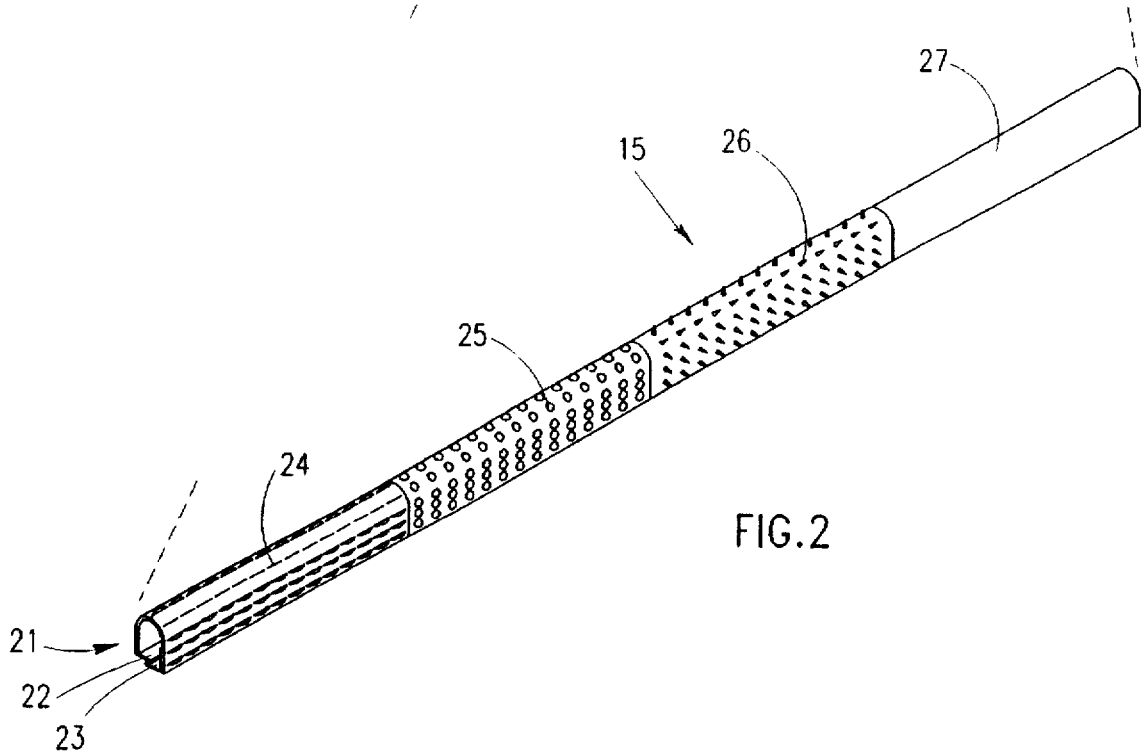
FIG. 2 is a perspective view of one embodiment of the present invention.

FIG. 1 is a perspective view of a guard rail structure 12 of a baby's crib or bed, comprising the guard rail 12 with an upper rim 11. FIG. 2 is a perspective view of a device 15 in accordance with one embodiment of the present invention, which can be attached to the upper rim 11 of the guard rail 12. The device 15 preferably comprises an enlarged member 21, having a U-shaped cross-section. At the lower end of the device 15 are two flaps 22, 23, which can grip the upper rim 11 of the guard rail 12. Other modes of attachment can be provided as well, such as adhesive.

The device 15 is provided with a plurality of protrusions 24 at its outer surface. The protrusions 24 can vary in shape and arrangement between adjacent sections 25, 26 and 27. The protrusions 24 can be of various shapes, such as small cones, ribs, cones with rounded upper ends, etc. or, even the shapes of objects or animals. The size and spacing of the protrusions 24 are preferably varied in different sections of the device 15. The protrusions 24 preferably have a diameter of up to several millimeters and a height of about 3–15 millimeters. The protrusions 24 can be spaced several millimeters apart.

The device or attachment 15 is preferably made of an inert pliable material, such as rubber, silicon rubber or suitable plastic polymer or copolymer, which can revert to its original shape and configuration after use. It is preferably of such shape so as to grab and/or grip the upper rim 11 when applied to it. It can be provided with means for securely attaching its two lower ends with each other, such as VELCRO (trademark for hook-and-loop fastening material), snaps, buttons or ties.

The present invention can stimulate other senses, as well. For example, the sections 25, 26, 27 of the device 11 may be scented with different fruity or flowery flavors to stimulate the sense of smell. The color of the adjacent sections 25, 26 and 27 can be varied, as well, to stimulate vision. The protrusions 24 can also be provided integral with the upper rim 11.

I claim:

1. An attachment for a guard rail of a childrens' bed or crib, comprising means for securing the attachment to the guard rail and on its outer surface a plurality of resilient protrusions, wherein said outer surface comprises a plurality of sections, each of which has protrusions of different sizes, spacings or configurations.

2. The attachment of claim 1, wherein the resilient material is rubber, silicon rubber, or a resilient plastic.

3. The attachment of claim 1, wherein the protrusions are in the shape of rows of upright cones with rounded tops, spaced from each other.

4. The attachment of claim 1, wherein sections are of different colors.

5. An attachment of claim 1, which has a U-shaped cross-section adapted to grip the guard rail.

6. An attachment of claim 5, which has lower edges which can be attached to each other, gripping the guard rail.

7. An attachment of claim 1, wherein some of the sections have different scents.

8. A guard rail for a children's bed or crib comprising an upper rim with resilient protrusions in the shape of upright cones with rounded tops, spaced from each other.

9. A guard rail of claim 8, comprising a plurality of sections with protrusions of different configurations.

10. A guard rail of claim 9, wherein some of the sections are of different colors or scents.

11. Apparatus for improving the sensory perception in children, comprising:

a guard rail of a children's bed or crib;

an attachment for said guard rail, said attachment having an outer surface on which a plurality of resilient protrusions are provided; and, means for securing said attachment to said guard rail.

12. The apparatus for improving the sensory perception in children according to claim 11 wherein said plurality of resilient protrusions is rubber or a resilient plastic.

13. The apparatus for improving the sensory perception in children according to claim 12, wherein said rubber is silicon rubber.

14. The apparatus for improving the sensory perception in children according to claim 11, wherein said resilient protrusions are shaped in rows of upright cones with rounded tops, spaced from each other.

15. The apparatus for improving the sensory perception in children according to claim 11, wherein the outer surface comprises a plurality of sections each of said sections having protrusions of different sizes, spacings or configurations.

16. The apparatus for improving the sensory perception in children according to claim 15, wherein said sections are of different colors.

17. The apparatus for improving the sensory perception in children according to claim 15, wherein at least some of said sections are provided with different scents.

18. The apparatus for improving the sensory perception in children according to claim 11, wherein said attachment includes a U-shaped cross-section adapted for gripping said guard rail.

19. The apparatus for improving the sensory perception in children according to claim 11, wherein said attachment includes a U-shaped cross-section having lower edges attachable to one another for gripping said guard rail.

* * * * *